United States Patent [19]

Miyanaka et al.

[11] Patent Number: 4,527,125

[45] Date of Patent: Jul. 2, 1985

[54] FLAME DETECTING APPARATUS

[75] Inventors: Motoshi Miyanaka; Kenzi Toudo; Toshiaki Sagawa, all of Yanai, Japan

[73] Assignee: Hitachi, Ltd., Tokyo, Japan

[21] Appl. No.: 435,553

[22] Filed: Oct. 21, 1982

[30] Foreign Application Priority Data

Nov. 13, 1981 [JP] Japan ..... 56-181129
Mar. 15, 1982 [JP] Japan ..... 57-39539

[51] Int. Cl.[3] ..... G01M 27/00; G06G 7/12

[52] U.S. Cl. ..... 328/6; 307/494; 431/19

[58] Field of Search ..... 431/19, 80, 76; 328/6; 73/75; 307/494; 340/577

[56] References Cited

U.S. PATENT DOCUMENTS 4,173,140 11/1979 Liebman et al. ..... 73/75
4,388,063 6/1983 Craig et al. ..... 431/19
4,396,370 8/1983 Yamana et al. ..... 431/80
4,436,505 3/1984 Yamaguchi et al. ..... 431/76

*Primary Examiner*—Stanley D. Miller
*Assistant Examiner*—B. P. Davis
*Attorney, Agent, or Firm*—Antonelli, Terry & Wands

[57] ABSTRACT

A flame detecting apparatus used in a combustion control apparatus for a water heater provided with a gas burner comprises a pressure switch serving as means for detecting presence or absence of flame and a voltage comparison circuit serving as means for determining the presence or absence of the flame on the basis of the input signal supplied by the pressure switch. The voltage comparison circuit has an offset voltage and has a non-inverting input terminal connected only to the ground. A first circuit including a first resistor and a diode connected in series to each other is connected in a loop together with the pressure switch, an impedance network and an AC voltage source so that an AC current which flows when the pressure switch is closed is rectified by the first circuit and a negative voltage obtained through the use of a capacitor or the like is applied to the inverting input terminal of the voltage comparison circuit to thereby detect the flame, while preventing erroneous operation of the voltage comparison circuit due to a short-circuit possibly produced across the resistor. By connecting a second resistor in parallel with at least the diode of the first circuit, erroneous detection of the flame ascribable to contact failure of the pressure switch as well as leakage is prevented. The capacitor may be replaced by a resistor to reduce expenditure.

14 Claims, 6 Drawing Figures

FLAME DETECTING APPARATUS

BACKGROUND OF THE INVENTION

1. Field of the Invention

The present invention relates in general to a flame detecting apparatus used in a combustion control system for a water heater or the like which is provided with a gas burner or the like. In particular, the invention concerns a flame detecting apparatus which includes a pressure switch serving as means for detecting presence or absence of flame and a voltage comparison circuit serving as means for determining the presence or absence of flame on the basis of the input signal supplied by the pressure switch.

2. Description of the Prior Art

In the burner in which the pressure switch is employed as the means for detecting the presence or absence of flame, a considerably high pressure prevails within a combustion chamber. As a typical example of such burner, there can be mentioned a pulse burner.

The pulse burner differs from the burner of general type where the flame is continuously maintained independent of time lapse in respect that the flames are produced intermittently in a pulse-like manner. Various types of the pulse burners have been heretofore known. However, in general, the pulse burner includes a combustion chamber, a valve for controlling the supply of gaseous fuel and air to the combustion chamber and an exhaust conduit which is designed as to cooperate with the combustion chamber to produce vibration of gas column at a predetermined frequency. The combustion chamber and the exhaust conduit serve as a heat exchanger. In operation, the fuel-air mixture is supplied to the combustion chamber through the control valve and ignited by an ignitor to burn explosively. Under the pressure thus produced by the explosive combustion, the control valve is forcibly closed, while the gaseous combustion products are discharged through the exhaust conduit. This results in that a vacuum (negative) pressure prevails within the combustion chamber, whereby the valve is again opened to feed the fuel-air mixture to the combustion chamber. In this way, the vibration of gas column is produced within the combustion chamber and the exhaust conduit. Under the action of the vibration of gas column, the after-burning (or remnant) flame or high temperature gas is compelled to be fed back to the combustion chamber to serve as an ignition source for triggering the explosive combustion of the new charged fuel-air mixture. The resultant increased pressure again forces to discharge the combustion product gas through the exhaust conduit. This cycle is successively repeated. In this manner, the combustion or burning takes place intermittently, that is, in the pulse-like manner.

The circuit provided internally of a combustion control apparatus used in combination with the pulse burner described above has to be imparted with a fail-safe feature so that short-circuit fault produced at any given time can not lead to dangerous state or situation.

The combustion control apparatus includes generally a voltage comparison circuit as the means for determining the presence or absence of the flame. This type of combustion control apparatus may be constituted, for example, by an integrated circuit element commercially available from Hitachi, Ltd. in Japan under the trade name "HA-16605W".

The pressure switch which is closed in response to the detection of flame is so combined with the voltage comparison circuit that when the pressure switch coupled to the inverting input terminal of the voltage comparison circuit is closed (i.e. when the flame is present), the voltage comparison circuit outputs a high level signal. Accordingly, if a short-circuit fault occurs, for example, across a resistor connected in parallel with the pressure switch in the open state of the pressure switch, the state equivalent to the closing of the pressure switch is brought about to cause the voltage comparison circuit to output the high level signal, involving erroneous operation.

Further, since a relatively low voltage is applied across the pressure switch with the result that electric fields produced in contacting surfaces of the switch contacts are feeble, erroneous operation of the combustion control apparatus may also take place due to the contact failure.

In a flame-rod type flame detecting apparatus, a voltage comparison circuit having a negative offset voltage is made use of, wherein the non-inverting input terminal of the voltage comparison circuit is connected only to the ground (earth) with an attempt to prevent the erroneous operation of the voltage comparison circuit due to the short-circuit fault of the resistor.

SUMMARY OF THE INVENTION

It is an object of the present invention to provide a fail-safe flame detecting apparatus for a burner or the like in which a combination of a pressure switch and a voltage comparison circuit is employed and in which erroneous operation due to the short-circuit fault of resistors and the like is positively prevented.

It is a second object of the invention to provide a fail-safe flame detecting apparatus which is made essentially immune to the erroneous or false operation due to the contact failure of the pressure switch.

A third object of the invention is to provide a fail-safe flame detecting apparatus which is prevented from erroneous or false operation due to leakage.

A fourth object of the invention is to provide a fail-safe flame detecting apparatus which can be fabricated inexpensively.

In view of the above objects, there is provided according to a general aspect of the invention a flame detecting apparatus for a combustion control system of a burner, which apparatus comprises a voltage comparison circuit having a negative offset voltage and a non-inverting input terminal connected only to the ground, a pressure switch and a circuit for producing a negative voltage at the output thereof in response to the operation of the pressure switch which indicates the presence of the flame. The output terminal of the negative voltage generating circuit is connected to the inverting input terminal of the voltage comparison circuit.

DESCRIPTION OF THE PREFERRED EMBODIMENTS

In the following, the invention will be described in detail in conjunction with exemplary embodiments by referring to the accompanying drawings.

Figure 1:
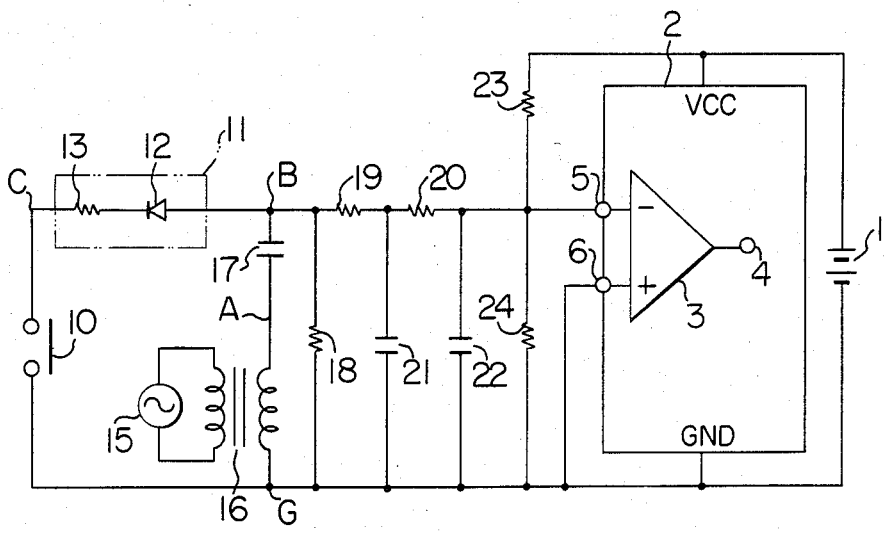
FIG. 1 is a circuit diagram showing a flame detecting apparatus according to an embodiment of the present invention.

Referring to FIG. 1, a numeral 1 denotes a DC power supply source, and 2 denotes a combustion control circuit implemented in a form of an integrated circuit, which may be constituted, for example, by an IC device commercially available from Hitachi, Ltd. in Japan under the trade name "HA-16605 W". The integrated circuit 2 incorporates a temperature detecting circuit, a timer, a control circuit and output circuits for a blower, a fuel valve, an igniter and the like (all of which are not shown) as well as an input circuit which includes a voltage comparison circuit 3 which will also be referred to as the voltage comparator.

Figure 2:
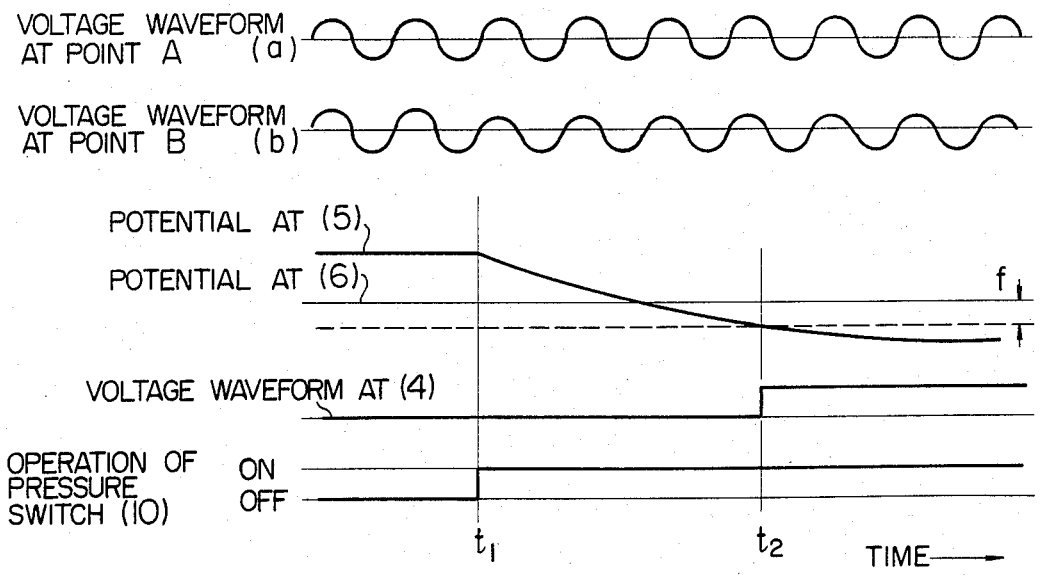
FIG. 2 shows waveforms of signals produced at various circuit points of the flame detecting apparatus shown in FIG. 1.

The voltage comparator 3 has an output terminal 4 which is connected to the above mentioned control circuit (not shown). When the output signal of a high level makes appearance at the output terminal 4 of the voltage comparator 3, the control circuit operates on the presumption that the flame is present. It should be noted that the voltage comparator 3 is so configured as to exhibit a negative offset voltage f as shown in FIG. 2 even when input voltages applied to the inverting input terminal 5 and the non-inverting input terminal 6 of the voltage comparator 3 are zero volts, as is illustrated in FIG. 2. The non-inverting input terminal 6 is connected only to the ground.

A reference numeral 10 denotes a pressure switch which is adapted to detect pressure prevailing in a combustion chamber of a burner and is actuated in response to the detected pressure. More specifically, when the detected pressure is high, indicating the presence of flame, the pressure switch 10 is turned on. A circuit equivalent to the flame (also referred to as the flame equivalent circuit) is denoted by a reference numeral 11 and includes a diode 12 and a resistor 13.

A reference numeral 16 denotes a step-up transformer having the primary winding connected to an AC power supply source 15 such as a commercial AC line and the secondary winding across which a voltage higher than the AC commercial voltage source, e.g. in a range of 100 to 200 volts, is produced. A reference numeral 17 represents a capacitance constituting an impedance circuitry, and 18 denotes a load resistor. A smoothing circuit is constituted by resistors 19 and 20 and capacitors 21 and 22. Resistors 23 and 24 cooperate to determine the bias voltage applied to the inverting input terminal 5 of the voltage comparator 3.

In connection with the circuit arrangement described above, it should be noted that when electrodes are provided at circuit points B and G which are brought into contact with the flame, the circuit portion constituted by the transformer 16, the capacitor 17, the smoothing circuit (19, 20, 21, 22) and the resistors 23 and 24 is identical with the circuit arrangement of a flame-rod type flame detecting apparatus in which the pressure switch 10 and the flame equivalent circuit 11 are not employed.

Describing operation of the flame detecting apparatus of the circuit configuration described above with the aid of signal waveform diagrams illustrated in FIG. 2, in which signal waveforms shown at (a), (b), (5), (6) and (4) correspond to the voltage waveforms produced at circuit points A, B, 5, 6 and 4 shown in FIG. 1, respectively, while a waveform shown at (10) illustrates operation of the pressure switch 10.

The secondary AC voltage of the step-up transformer 16 having the primary side connected to the AC voltage source 15 is applied to the pressure switch 10 through the capacitor 17 and the flame equivalent circuit 11. At the time point at which the igniting operation is triggered, the pressure switch 10 is in the open or OFF state because of absence of the flame. Accordingly, in this state, there makes appearance across the capacitor 17 the AC voltage as it is. The AC component is removed by the smoothing circuit composed of the resistors 19 and 20 and the capacitors 21 and 22, resulting in that no DC voltage component is produced across the capacitor 17. Since the voltage divider resistors 23 and 24 are so selected that the potential making appearance at the junction therebetween is higher than zero volts in this state, the voltage comparison circuit 3 produces the output of a low level.

When the pressure within the combustion chamber is increased after ignition of the air fuel mixture as triggered by the ignitor per se known as driven by the integrated circuit 2, the pressure switch 10 is turned on at a time point $t_1$. In consequence, a circuit loop including the secondary winding of the step-up transformer 16, the capacitor 17, the flame equivalent circuit 11 and the pressure switch 10 is closed. Thus, so far as the circuit point B is at positive polarity, i.e. during a positive half cycle of the AC voltage, an AC current flows through the flame equivalent circuit 11 to undergo half-wave rectification. Of course, no current flows during the negative half cycle. Consequently, the capacitor 17 is so charged that the end or terminal thereof connected to the resistor 19 is at negative polarity. The voltage produced at the circuit point B thus varies in a manner illustrated at (b) in FIG. 2. The negative DC voltage is smoothed by the smoothing circuit mentioned above, as the result of which the voltage applied to the inverting input terminal 5 of the voltage comparator 3 is a negative voltage lower than the offset voltage f. On the other hand, the voltage applied to the non-inverting input terminal 6 of the comparator 3 is constantly zero volts. In consequence, the voltage produced at the output terminal 4 of the voltage comparator 3 becomes high at a time point $t_2$ to thereby indicate the presence of the flame. The control circuit incorporated in the integrated circuit 2 determines then that the ignition has taken place and combustion continues, to thereby allow the fuel supply to be continued.

The foregoing concerns the normal operation of the flame detecting apparatus.

Now, it is assumed that the fault occurs due to the short circuit of the capacitor 21 or the resistor 24 or the voltage comparison circuit 3 (whose inverting input terminal is assumed to be short-circuited) in the state in which the pressure switch 10 is in the open or OFF state. On the condition, the voltage applied to the inverting input terminal 5 of the voltage comparator 3 is lowered only to zero volts rather than to minus (−) f volts. Accordingly, no inversion occurs in the voltage comparator 3, resulting in that no signal indicative of the presence of flame is outputted. In this way, even when the short-circuit fault occurs in the course of the igniting operation or during the combustion process with the ignition failing or the flame extinguishing, the voltage comparison circuit 3 is in the state to output the low level signal indicative of the absence of flame on the basis of the output signal of the pressure switch 10. The control circuit incorporated in the IC 2 stops the igniting operation or the combustion. Thus, the safety or fail-safe function, can be assured.

The circuit point C, the pressure switch 10 and the circuit point G are physically so designed that predetermined insulation distances are to be maintained among them in accordance with the safety standards (e.g. insulation distance of 0.8 mm must be provided in accordance with the AGA Standards of U.S.A.). Accordingly, it may be assumed that no short-circuit occurs between the circuit point C and the pressure switch 10 on one hand and between the circuit point G and the pressure switch 10 on the other hand. Further, it may be considered that no short-circuit fault occurs in the case of the pressure switch realized in conformance with the UL Standards.

In the case of the disconnection or breakdown fault, the rectifying action of the flame equivalent circuit 11 can assure the fail-safe function. To dispose with the disconnection fault between the non-inverting input terminal 6 of the voltage comparison circuit 3 and the ground, an additional voltage comparison circuit may be provided in a duplicated configuration.

It should further be mentioned that, so far as the pressure switch 10 is applied with a sufficiently high voltage, the contact failure which is likely to occur in case the voltage applied to the pressure switch 10 is low can be avoided. Although magnitude of the voltage applied to the pressure switch 10 to this end can not be determined definitely, the commercial line voltage will usually be sufficient. Of cource, magnitude of the current provides an influential factor. However, the current can be conveniently increased by using the transformer 16 of a correspondingly large capacity.

As will be appreciated from the foregoing description, a flame-rod type flame detecting apparatus can be obtained, when the pressure switch 10 and the flame equivalent circuit 11 are replaced by a pair of electrodes which can be brought into contact with the flame. In other words, modification of the flame-rod type flame detecting apparatus into the pressure switch type flame detecting apparatus can be extremely easily accomplished merely by providing additionally the flame equivalent circuit 11 and the pressure switch 10.

When the flame-rod type flame detecting apparatus is to be combined with a pulse burner, it is necessary to select the frequency of the AC voltage applied across the flame to be sufficiently higher than that of the frequency of the pulse-like combustion so that the flame may be adequately applied thereacross with the positive half cycle of the AC voltage. For example, in case the frequency of the pulse-like combustion is in a range of 50 to 80 Hz, the frequency of the AC voltage applied across the flame should preferably be higher than 200 Hz.

Next, description will be made on the flame detecting apparatus according to another embodiment of the present invention shown in FIG. 3. The pressure switch 10B used in this flame detecting apparatus is so constructed as to be turned off in response to the absence of flame. Further, the flame equivalent circuit 11 is connected in parallel with the pressure switch 10B in such a manner that the connecting points lie at the connecting terminals **10*a* and 10*b* of the pressure switch 10B, respectively. The remaining circuit portion is of the same configuration as that of the flame detector shown in FIG. 1**.

Figure 3:
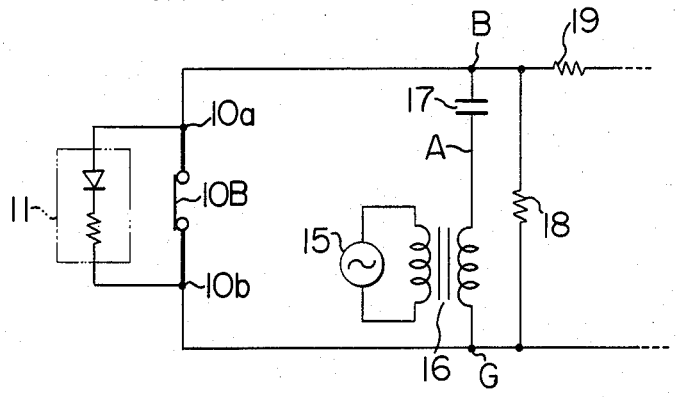
FIG. 3 is a circuit diagram showing a main portion of the flame detecting apparatus according to another embodiment of the invention.

Operation of the flame detecting apparatus shown in FIG. 3 is thus different from that of the flame detector shown in FIG. 1 only in respect of the operation of the pressure switch 10B. More specifically, when the pressure switch 10B is turned off in response to the detection of flame, the flame equivalent circuit 28 is electrically energized to allow a flame current to flow therethrough, whereby the flame is detected by the voltage comparison circuit 3. When a short-circuit fault occurs in the pressure switch 10B or between the circuit points B and G, no flame current can flow, thus assuring the safety feature. Since the flame equivalent circuit 11 is connected to the pressure switch 10 in any case, erroneous operation will take place when disconnection or break-down fault occurs between the connecting junctions and the pressure switch 10. Under the circumstances, the flame equivalent circuit 11 is connected directly to the connecting terminals **10*a* and 10*b* of the pressure switch 10B in case of the embodiment shown in FIG. 3. Thus, no disconnection fault is expected to occur between these connecting terminals and the associated contacts of the pressure switch 10B because of the fact that the connecting terminals are usually made of thick members and so forth. Upon occurrence of the disconnection or break-down fault at other locations, the flame detector apparatus shown in FIG. 3 operates in the substantially same manner as the flame detector shown in FIG. 1**.

In the case of the flame detecting apparatus shown in FIG. 1, the current which is allowed to flow through the flame equivalent circuit 11 is of very small magnitude and usually on the order of 500 $\mu$A, which in turn means that the current flowing through the pressure switch 10 is also of a correspondingly small value. For this reason, failure in contact is likely to occur in the pressure switch 10 of the apparatus shown in FIG. 1.

Such contact failure can be prevented by increasing the current value in concern. However, considering that the current is a direct current and that the capacitor 17 is interposed between the flame equivalent circuit and the AC voltage source, the current value can not be increased to a desired level even when the resistance value of the flame equivalent circuit 11 is decreased. Besides, when a leakage which leads to the short-circuit of the pressure switch 10 is produced, the negative voltage generating circuit produces a negative voltage even if the leakage resistance is of a large value.

Figure 4:
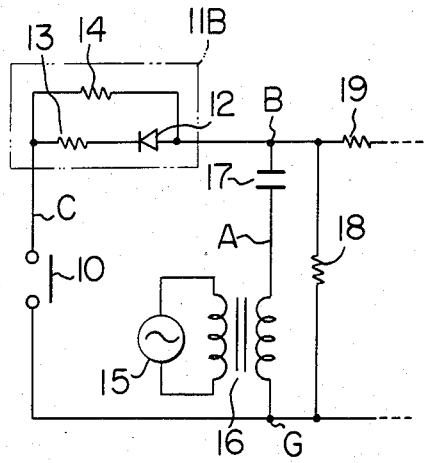
FIG. 4 is a circuit diagram showing a main portion of the flame detecting apparatus according to still another embodiment of the invention.

FIG. 4 shows the flame detecting apparatus according to a further embodiment of the present invention which is so configured as to prevent erroneous flame detection from occurring due to the contact failure of the pressure switch and the leakage mentioned above. Referring to the figure, the flame detecting apparatus differs from the one shown in FIG. 1 in that a resistor 14 is additionally inserted in the flame equivalent circuit 11. The resistor 14 may have the same value as that of the resistor 13 and 24 K$\Omega$, by way of example. The remaining circuit portion is of the same arrangement as that of the embodiment shown in FIG. 1.

With the arrangement shown in FIG. 4, the current flows toward the pressure switch 10 through the resistor 14 and the series connection of the resistor 13 and the diode 12 during the positive half cycle of the AC voltage. On the other hand, during the negative half cycle, the current flows only toward and through the resistor 14 from the pressure switch 10. In this connection, it should be noted that the resistance values of the resistors 13 and 14 are so set that value of the current flowing through the pressure switch 10 during the negative half cycle is greater as compared with the current flow during the positive half cycle. Consequently, the capacitor 17 is charged with such a polarization that the end thereof connected to the resistor 19 is at negative polarity, whereby detection of the flame is effected.

Now, assuming that the resistor 14 is not inserted in the flame equivalent circuit 11B, the value of the current which flows through the pressure switch 10 and which is a direct current is determined by the resistance values of the resistors 13, 18, 19, 20, 23 and 24. Accordingly, even when the value of the resistor 13 is decreased, the value of the current flowing through the pressure switch 10 can not be increased. In contrast, when leakage occurs at the circuit point C, the voltage comparison circuit 3 produces the high level output signal independent of magnitude of the leakage resistance. For these reasons, the resistance value of the resistor 13 may well be selected greater.

In contrast, in case of the flame detector circuit shown in FIG. 4, the current of an increased value can flow through the pressure switch 10 even during the negative half cycle by virtue of the parallel connection of the resistor 14. The value of the resistor 13 can thus be made smaller. Further, since the negative voltage is produced due to the difference between the currents flowing during the positive half cycle and the negative half cycle, respectively, which means that the current can flow during the negative half cycle even upon occurrence of leakage, the current value which is required for inverting the voltage comparator 3 can not be obtained when the leakage resistance is of a great value. Consequently, no flame detection is made when the leakage resistance is high, as is the case of the conventional flame detector.

By way of example, assuming that the applied AC voltage is 120 volts and that the resistors 13 and 14 are of 22 KΩ, respectively, the current which can flow through the pressure switch 10 is 5 mA, whereby the detection of flame can be prevented upon occurrence of leakage with leak resistance of 200 KΩ. Further, with the switch current on the order of 5 mA, the contact failure can be prevented. In this connection, it should also be noted that too great a value of the resistor 13 is likely to bring about the contact failure while too small a value of the resistor 13 increases the likelihood of occurrence of the leakage. In general, the values of the resistor 13 and the resistor 14 should be preferably same.

As a version of the circuit arrangement shown in FIG. 1, the resistor 14 may be connected in parallel with only the diode 12. It is, however, believed that the resistance values of the resistors 13 and 14 can be determined more easily by connecting them in the manner described above.

Figure 5:
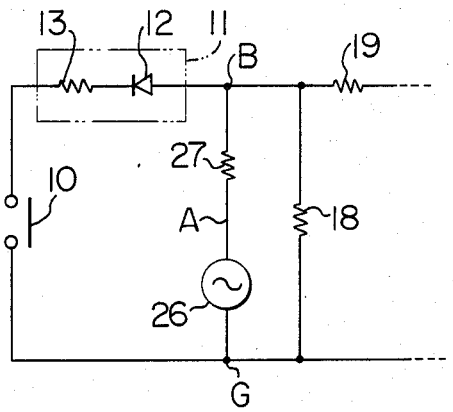
FIG. 5 is a circuit diagram showing a main portion of the flame detecting apparatus according to a further embodiment of the invention.

In the case of the embodiment shown in FIG. 1, the capacity of the capacitor 17 is in reverse proportion to the frequency of the AC voltage applied to the transformer 16. Accordingly, when a current of magnitude sufficiently large for preventing the occurrence of the contact failure of the pressure switch 10 is attempted to flow at a frequency (50 or 60 Hz) equal to that of the commercial AC line, the capacitance of the capacitor 17 must be correspondingly increased, involving high expenditure. FIG. 5 shows a further embodiment of the invention with which it is contempleted to eliminate the drawbacks mentioned above.

Referring to FIG. 5, a reference numeral 26 denotes an AC voltage source of a low voltage, e.g. 24 volts, and 27 denotes a resistor constituting the impedance network. The remaining circuit portion is of the same arrangement as the one shown in FIG. 1.

With the circuit arrangement shown in FIG. 5, the highest voltage at the circuit point B is determined by the following expression:

$$\frac{\text{voltage of AC voltage source 26} \times \text{value of resistor 13}}{\text{value of resistor 13} + \text{value of resistor 27}}$$

This voltage is smoothed by the smoothing circuit and converted into a negative voltage.

By virtue of the use of the resistor 27, the circuit shown in FIG. 5 can be realized inexpensively. It should however be mentioned that the use of the resistor 27 tends to degrade the resistivity of the flame detection as compared with the capacitive circuit. Accordingly, this resistor 27 can not be used in the flame-rod type flame detecting circuit in general in which the pressure switch is not employed, because the flame exhibits a high impedance. In contrast, in the flame detecting circuit in which the pressure switch is made use of, the resistance 13 of the flame equivalent circuit 11 can be arbitrarily set so as to present a low impedance. It is also possible to make available a large current without involving contact failure of the pressure switch 10.

In case of the embodiment shown in FIG. 5, the flame equivalent circuit 11 may be replaced by the circuit 11B shown in FIG. 4.

Figure 6:
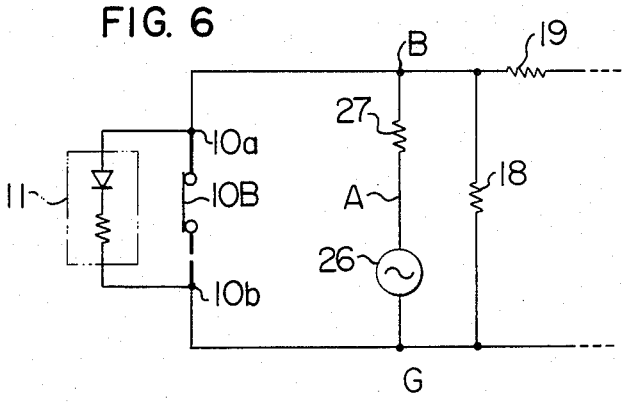
FIG. 6 is a circuit diagram showing a main portion of the flame detecting apparatus according to a still further embodiment of the invention.

FIG. 6 shows the flame detecting circuit according to a further embodiment of the invention which corresponds to a combination of the embodiments shown in FIGS. 3 and 5. Since the arrangement and operation of this circuit are self-explanatory, further description will be unnecessary.

The flame equivalent circuit 11 shown in FIG. 6 may also be replaced by the circuit 11B shown in FIG. 4.

We claim:

1. A flame detecting apparatus, comprising:

a voltage comparison circuit which produces an output signal of high level in response to operation of a pressure switch indicative of the presence of flame, said voltage comparison circuit having a negative offset voltage and having a non-inverting input terminal connected to the ground;

a first circuit including a diode and a first resistor connected in series to each other;

said first circuit being connected to said pressure switch to form with said pressure switch a second circuit;

wherein said second circuit, an impedance circuit and an AC voltage source are sequentially connected to one another so that an AC current flows to said first circuit from said AC voltage source in response to operation of said pressure switch indicating the presence of flame, said impedance circuit having an output terminal connected to an inverting input terminal of said voltage comparison circuit through a smoothing circuit and a bias circuit.

2. A flame detecting apparatus according to claim 1, wherein said AC voltage source generates a voltage not lower than 100 volts.

3. A flame detecting apparatus according to claim 1, wherein said pressure switch is so constructed as to be turned on in response to the presence of flame and connected in series to said first circuit.

4. A flame detecting apparatus according to claim 1, wherein said pressure switch is so constructed as to be turned off in response to the presence of flame and said first circuit is connected in parallel with said pressure switch.

5. A flame detecting apparatus according to claim 1, wherein said first circuit includes a second resistor connected in parallel with at least said diode, said first and second resistors having respective resistance values so set that a current flowing through said pressure switch in one direction by way of said diode and said first resistor has a larger value than a current flowing through said pressure switch in the other direction opposite to said one direction without passing through said diode. .

6. A flame detecting apparatus according to claim 5, wherein said second resistor is connected in parallel with said first resistor and said diode.

7. A flame detecting apparatus according to claim 1, wherein said impedance circuit is constituted by a resistor.

8. A flame detecting apparatus comprising:

a pressure switch for being turned on or off in response to a flame;

a flame equivalent circuit connected to said pressure switch, said flame equivalent circuit including a diode and a first resistor connected in series;

an impedance circuit connected to said pressure switch and said flame equivalent circuit;

an AC voltage means connected to said impedance circuit;

a smoothing circuit connected to said impedance circuit;

a bias circuit connected to said smoothing circuit; and a voltage comparison circuit having a negative offset voltage, a non-inverting input terminal connected to ground, and an inverting input terminal connected to said bias circuit, said voltage comparison circuit outputting a signal of high level in response to presence of the flame, whereby said voltage comparison circuit does not output a high level signal when an open-circuit or short-circuit fault occurs in said flame equivalent circuit, said impedance circuit, said smoothing circuit, or said bias circuit and when a flame is not present.

9. A flame detecting apparatus according to claim 8, wherein said AC voltage means provides a voltage not lower than 100 volts.

10. A flame detecting apparatus according to claim 8, wherein said pressure switch is so constructed as to be turned on in response to the presence of flame and is connected in series with said flame equivalent circuit.

11. A flame detecting apparatus according to claim 8, wherein said pressure switch is so constructed as to be turned off in response to the presence of flame and said flame equivalent circuit is connected in parallel with said pressure switch.

12. A flame detecting apparatus according to claim 8, wherein said flame equivalent circuit further includes a second resistor connected in parallel with at least said diode, said first and second resistors having respective resistance values so set that a current flowing through said pressure switch in one direction by way of said diode and said first resistor has a larger value than a current flowing through said pressure switch in the other direction opposite to said one direction without passing through said diode.

13. A flame detecting apparatus according to claim 12, wherein said second resistor is connected in parallel with said first resistor and said diode.

14. A flame detecting apparatus according to claim 8, wherein said impedance circuit is constituted by a resistor.

* * * * *